US010061244B2

(12) United States Patent
Kang

(10) Patent No.: US 10,061,244 B2
(45) Date of Patent: Aug. 28, 2018

(54) GUIDE BUSHING DISPOSED AT AN END OF A NIP FORMING MEMBER TO SUPPORT AN END OF A FIXING BELT

(71) Applicant: S-Printing Solution Co., Ltd., Suwon-si (KR)

(72) Inventor: Min-seok Kang, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/672,457

(22) Filed: Aug. 9, 2017

(65) Prior Publication Data

US 2018/0143572 A1 May 24, 2018

(30) Foreign Application Priority Data

Nov. 23, 2016 (KR) ..... 10-2016-0156766

(51) Int. Cl.
*G03G 15/20* (2006.01)

(52) U.S. Cl.
CPC ..... *G03G 15/2067* (2013.01); *G03G 15/2028* (2013.01); *G03G 15/2032* (2013.01); *G03G 15/2053* (2013.01); *G03G 2215/2038* (2013.01); *G03G 2221/1639* (2013.01)

(58) Field of Classification Search
CPC ..... G03G 15/2017; G03G 15/2028; G03G 15/2053
USPC ..... 399/329
See application file for complete search history.

(56) References Cited

U.S. PATENT DOCUMENTS

| | | | | |
|---|---|---|---|---|
| 7,130,572 | B2 | 10/2006 | Kubochi et al. | |
| 8,060,001 | B2 * | 11/2011 | Lee | G03G 15/2053 399/329 |
| 9,063,479 | B2 | 6/2015 | Jensen et al. | |
| 2013/0202335 | A1 | 8/2013 | Hasegawa | |

FOREIGN PATENT DOCUMENTS

| | | |
|---|---|---|
| JP | 2010-217587 | 9/2010 |
| JP | 2014-160245 | 9/2014 |
| JP | 2016-38451 | 3/2016 |

* cited by examiner

*Primary Examiner* — William J Royer
(74) *Attorney, Agent, or Firm* — Staas & Halsey LLP

(57) ABSTRACT

A fixing apparatus for an image forming apparatus includes: a fixing belt; a pressure roller configured to face the fixing belt; a nip forming member configured to be disposed inside the fixing belt and press the fixing belt to the pressure roller to form a nip; and first and second guide bushings configured to be disposed at both ends of the nip forming member, respectively, in which the first and second guide bushings each support both end supports both ends of the fixing belt in a state in which a part thereof is movable.

20 Claims, 20 Drawing Sheets

GUIDE BUSHING DISPOSED AT AN END OF A NIP FORMING MEMBER TO SUPPORT AN END OF A FIXING BELT

CROSS-REFERENCE TO RELATED APPLICATIONS

This application claims priority from Korean Patent Application No. 10-2016-0156766, filed on Nov. 23, 2016 in the Korean Intellectual Property Office the disclosure of which is incorporated herein by reference in its entirety.

BACKGROUND OF THE INVENTION

Field of the Invention

Apparatuses consistent with the present disclosure relate to a fixing apparatus used for an image forming apparatus, and more particularly, to a fixing apparatus having a guide bushing, a part of which may move, and an image forming apparatus having the same.

Description of the Related Art

An image forming apparatus is an apparatus for printing an image on a print medium and may be a printer, a copier, a facsimile, and a multifunctional apparatus in which functions thereof are integrated, or the like.

Generally, an electrophotographic image forming apparatus such as a laser printer scans light to a photoreceptor charged with a predetermined potential to form an electrostatic latent image on a surface of the photoreceptor and then supplies a toner to the electrostatic latent image to form a visible image. The visual image formed on the photoreceptor is directly transferred to the print medium or transferred to the print medium through an intermediate transfer body, and the visual image transferred to the print medium is fixed on the print medium while passing through the fixing apparatus.

The fixing apparatus includes a heat source, a fixing belt that is configured of a belt and the like, and a pressure roller that comes into close contact with the fixing belt to form a fixing nip. The fixing belt needs to rotate only in an axial direction during the fixing process to form the fixing nip along with the pressure roller, but the fixing belt axially moves in a meandering manner because frictional force distributions on inner and outer surfaces of the fixing belt are different unless a rotating shaft of the fixing belt and a rotating shaft of the pressure roller are parallel with each other.

If the fixing belt moves in the meandering manner, both end portions of the fixing belt come into contact with a guide bushing supporting the rotation of the fixing belt, and form scratches or grooves on the guide bushing. There is a problem in that the fixing belt may be worn or damaged due to the scratches or grooves on the guide bushing.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a fixing apparatus supporting a fixing belt in a state in which a part of a guide bushing is movable to be able to reduce a shock and a deformation of the fixing belt due to a guide bushing as a rotation trajectory is changed.

According to an aspect of the present disclosure, a fixing apparatus includes: a fixing belt including a first and a second end; a pressure roller configured to contact the fixing belt; a nip forming member configured to press the fixing belt to the pressure roller to form a nip, the nip forming member including a first and a second end; and first and second guide bushings configured to respectively be disposed at the first and second ends of the nip forming member to respectively support the first and second ends of the fixing belt each of the first and second guide bushings including a moving member configured to be movable.

Each of the first and second guide bushings may include: a fixed member configured to be fixed to the nip forming member; and the moving member configured to be coupled to the fixed member in a state.

The moving member may be coupled to the fixed member with a gap between a side surface of the moving member and the fixed member.

The fixed member may include: a support portion including a receiving groove into which the moving member is insertable; and a coupling member configured to be coupled to the moving member so that the moving member remains in the receiving groove.

The coupling member may be disposed under the receiving groove.

The receiving groove may be spaced apart from both side surfaces of the moving member.

The moving member may include a hook portion protruding downward, and a lower end of the hook portion may be provided with a hook ring coupled to a side surface of the coupling member.

The hook ring and the coupling member may be coupled to each other and form a gap.

The moving member may be spaced apart from the fixed member in a width direction of the fixing belt.

The moving member may be spaced apart from the fixed member in a height direction of the fixing belt.

The support portion may be provided with an elastic member configured to elastically support the moving member to support the moving member to the support portion at a gap.

The moving member may be formed to be convex in a central direction of the fixing belt.

The moving member may include a plurality of rollers configured to be rotatably coupled to the fixed member.

The plurality of rollers may be disposed to have a rotating shaft perpendicular to a longitudinal direction of the fixing belt.

The plurality of rollers may be disposed in parallel with each other.

The plurality of rollers may be disposed to have a rotating shaft coinciding with a normal line with respect to a rotation trajectory of the fixing belt.

The moving member may further include a roller support portion configured to support the plurality of rollers, and the roller support portion may be provided with a plurality of roller grooves in which the plurality of rollers are correspondingly disposed.

The roller may be disposed at an upper part or a lower part of the roller groove at a gap.

The roller support portion may be formed so that the plurality of rollers protrude in a central direction of the fixing belt from the roller support portion.

According to another aspect of the present disclosure, an image forming apparatus includes: a photoreceptor configured to form an electrostatic latent image; a developing unit configured to supply a toner to the electrostatic latent image to form a toner image on a recording medium; and a fixing apparatus configured to apply heat and a pressure to the toner image formed on the recording medium to fix the toner image to the recording medium, in which the fixing apparatus may include a fixing belt including a first end and a second end, a pressure roller configured to contact the fixing belt, a nip forming member configured to be disposed inside the fixing belt and press the fixing belt to the pressure roller to form a nip, the nip forming member including a first end and a second end, and first and second guide bushings configured to be respectively disposed at the first and second ends of the nip forming member, and wherein each of the first and second guide bushings may include a moving member configured to move in a plane substantially perpendicular to an axis of rotation of the fixing belt.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Hereinafter, a belt type fixing apparatus and an image forming apparatus having the same according to exemplary embodiments of the present disclosure will be described in detail with reference to the accompanying drawings.

Exemplary embodiments described below are exemplarily described to help understanding of the present disclosure and therefore it is to be understood that the present disclosure may be variously changed differently from the exemplary embodiments described herein. However, in describing the present disclosure, if it is determined that the detail description of relevant known functions or components makes subject matters of the present disclosure obscure, the detailed description and illustration thereof will be omitted. Further, to help understanding of the present disclosure, the accompanying drawings are not necessarily illustrated to scale but dimensions of some components may be illustrated to be exaggerated.

Hereinafter, an image forming apparatus 1000 according to an exemplary embodiment of the present disclosure will be schematically described with reference to FIG. 1, and then a fixing apparatus 1 will be described in detail.

Figure 1:
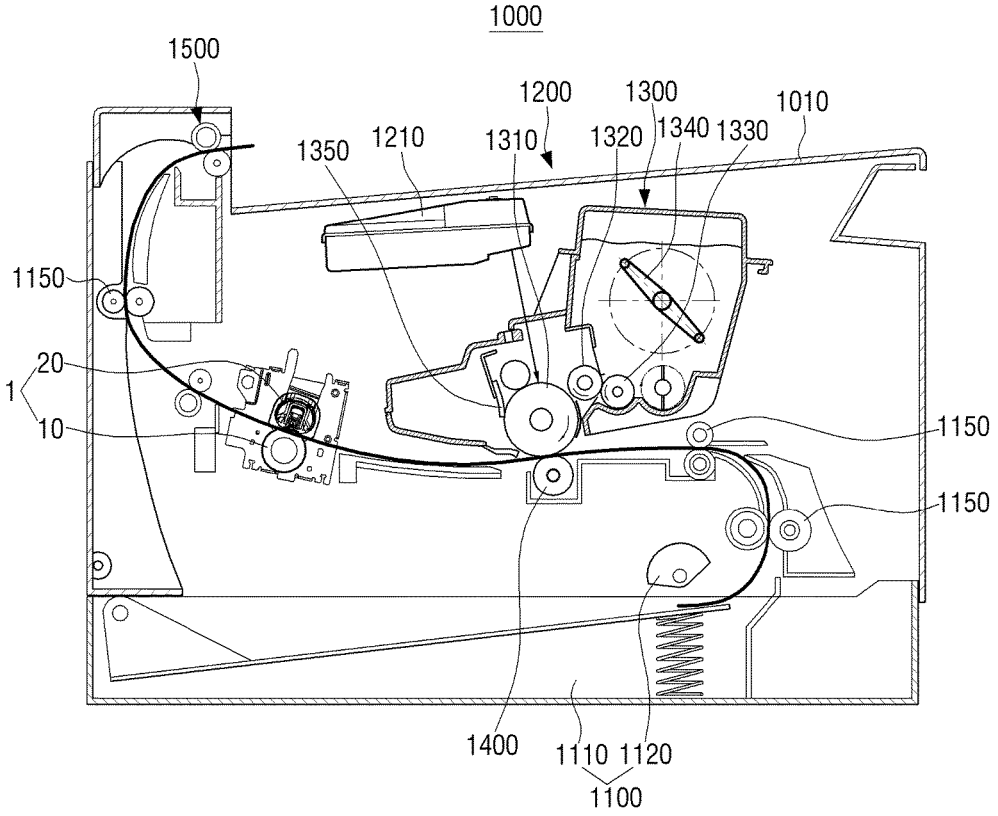
FIG. 1 is a cross-sectional view schematically showing an image forming apparatus having a fixing apparatus according to an exemplary embodiment of the present disclosure.

FIG. 1 is a cross-sectional view schematically showing the image forming apparatus 1000 having the fixing apparatus 1 according to an exemplary embodiment of the present disclosure.

The image forming apparatus 1000 is configured to include a main body 1010, a print medium supplying apparatus 1100, an image forming portion 1200, the fixing apparatus 1, and a print medium discharging apparatus 1500.

The main body 1010 forms an appearance of the image forming apparatus 1000, and supports various components installed therein. The main body 1010 includes a cover (not shown) provided to open and close a part thereof and a body frame (not shown) supporting or fixing various components inside the main body 1010.

The print medium supplying apparatus 1100 supplies a print medium P to the image forming portion 1200. The print medium supplying apparatus 1100 includes a paper feed cassette 1110 on which the print medium P is loaded and a pick-up roller 1120 that picks up the print mediums loaded on the paper feed cassette 1110 sheet by sheet. The print medium P picked up by the pick-up roller 1120 is transferred toward the image forming portion 1200 by the transfer rollers 1150.

The image forming portion 1200 forms a predetermined image on the print medium P and includes an exposure unit 1210, a developing cartridge 1300, and a transfer roller 1400. The exposure unit 1210 emits predetermined light corresponding to print data in response to a print command. The developing cartridge 1300 includes an image carrier (photoreceptor) 1310 on which an electrostatic latent image is formed by the light emitted from the exposure unit 1210 and a developing roller (developing unit) 1320 that is installed on one side of the image carrier 1310 and supplies a developer to the image carrier 1310 to develop the electrostatic latent image formed on the image carrier 1310 into a developer image. In addition, the developing cartridge 1300 includes a developer supply roller 1330 that stores a predetermined amount of developer and supplies the developer to the developing roller 1320, an agitator 1340 that agitates the developer, a cleaning blade 1350 that cleans a surface of the image carrier 1310, or the like. The transfer roller 1400 is installed to rotate while facing the image carrier 1310 of the developing cartridge 1300 and transfers the developer image formed on the image carrier 1310 to the print medium P.

The fixing apparatus 1 fixes the developer image on the print medium P by applying heat and pressure during the passage of the print medium P onto which the developer image is transferred in the image forming portion 1200, which will be described below in detail.

The print medium discharging apparatus 1500 discharges the print medium to an outside of the main body 1010. The print medium discharging apparatus 1500 may include a pair of discharge rollers that rotates while facing each other.

Hereinafter, the fixing apparatus 1 according to the exemplary embodiment of the present disclosure will be described in detail with reference to the drawings.

Figure 2A:
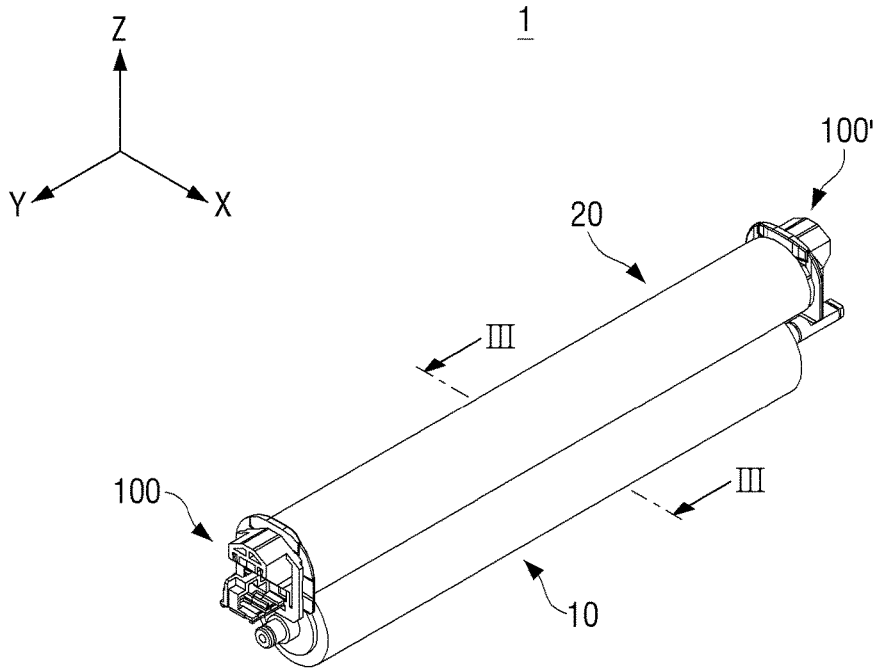
FIG. 2A is a perspective view showing the fixing apparatus according to an exemplary embodiment of the present disclosure.
Figure 2B:
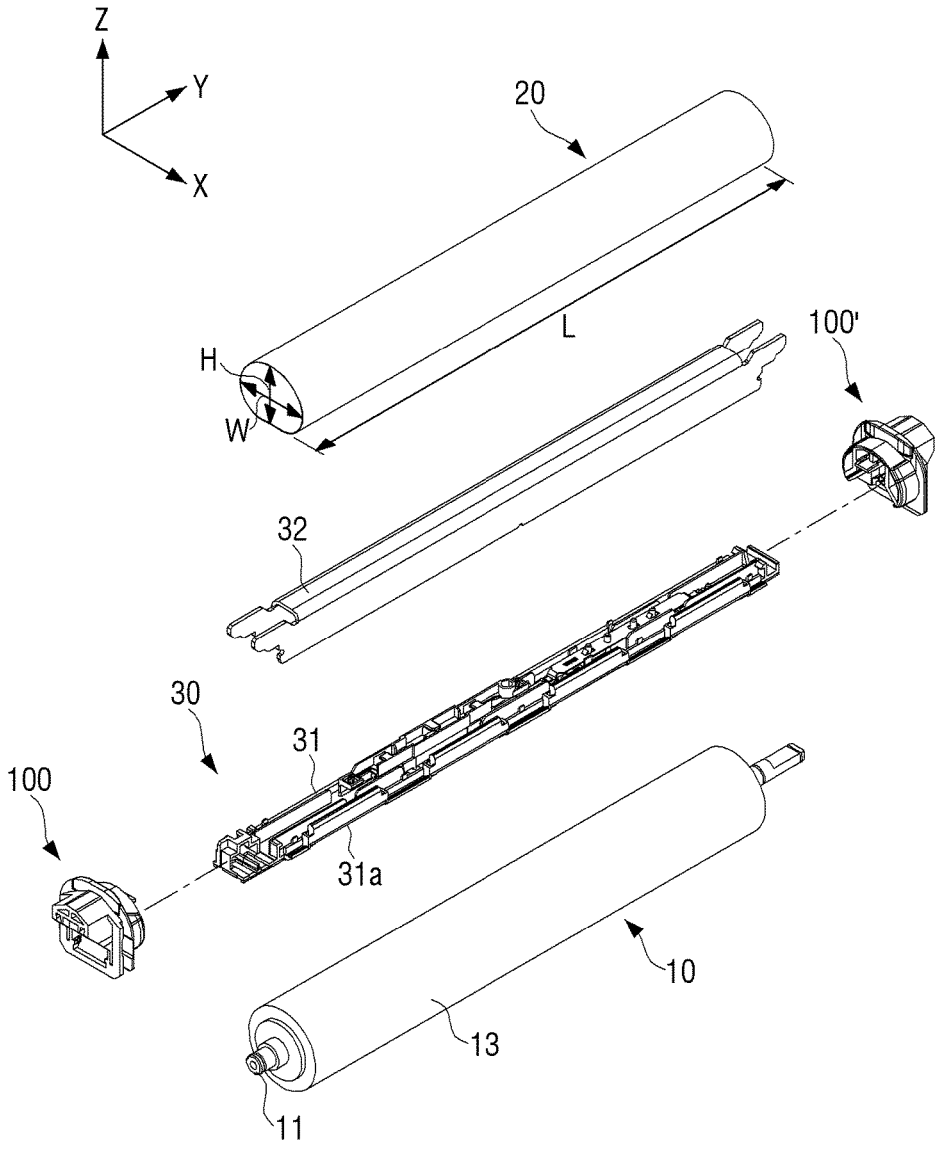
FIG. 2B is an exploded perspective view of the fixing apparatus of FIG. 2A.
Figure 3:
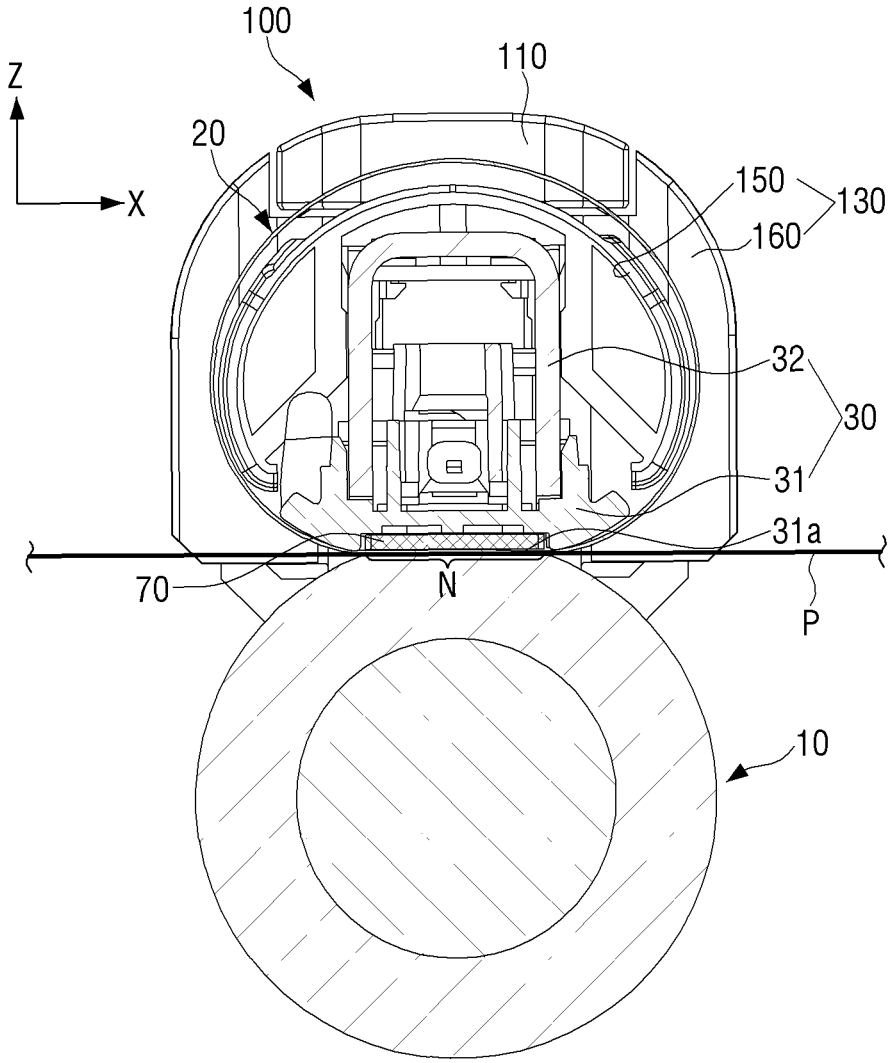
FIG. 3 is a cross-sectional view taken along the line shown in FIG. 2A.

FIG. 2A is a perspective view showing the fixing apparatus 1 according to the exemplary embodiment of the present disclosure, FIG. 2B is an exploded perspective view of the fixing apparatus 1 of FIG. 2A, and FIG. 3 is a cross-sectional view taken along the line shown in FIG. 2A. In the drawings, an X-axis direction X means a width direction W of a fixing belt 20, a Y-axis direction Y means a longitudinal direction L of the fixing belt 20, and a Z-axis direction Z means a height direction H of the fixing belt 20.

Referring to FIGS. 2A, 2B and 3, the fixing apparatus 1 according to the exemplary embodiment of the present disclosure includes a pressure roller 10, a fixing belt 20, a nip forming member 30, and a pair of guide bushings 100 and 100'.

If the print medium P onto which the toner image has been transferred enters between the fixing belt 20 and the pressure roller 10, the toner image is fixed on the print medium P by heat transferred from a heat source 70 and a pressure applied from a fixing nip N (see FIG. 3). An inside of the fixing belt 20 is provided with a nip forming member 30 to be supported, thereby forming the fixing nip N between the fixing belt 20 and the pressure roller 10.

The pressure roller 10 is disposed to come into contact with an outer circumferential surface of the fixing belt 20 to form the fixing nip N between the pressure roller 10 and the fixing belt 20. The pressure roller 10 is configured to rotate by receiving power from a driving source (not shown), and the pressure roller 10 is rotatably supported on the frame of the image forming apparatus 1000. The pressure roller 10 applies a predetermined pressure to the print medium P and is formed in a roller shape. The pressure roller 10 includes a shaft 11 that is made of a metal material such as aluminum or steel and an elastic layer 13 that is elastically deformed and forms the fixing nip N between it and the fixing belt 20. The elastic layer 13 is typically made of silicone rubber. The fixing belt 20 rotates by a frictional force between the fixing belt 20 and the pressure roller 10 if the pressure roller 10 rotates. The fixing belt 20 rotates in engagement with the pressure roller 10 and forms the fixing nip N through which the print medium P passes together with the pressure roller 10. The fixing belt 20 is heated by the heat source 70 to apply predetermined heat to the print medium P passing through the fixing nip N. The fixing belt 20 is formed as an endless belt having a substantially cylindrical shape and an axial length of the fixing belt 20 may be longer than that of the pressure roller 10.

The fixing belt 20 may be configured of a single layer of metal, a heat-resistant polymer or the like or may be configured of an elastic layer and a protective layer in addition to a base layer made of the metal or the heat-resistant polymer. The nip forming member 30 is provided inside the fixing belt 20, and applies a pressure to an inner circumferential surface of the fixing belt 20 to form the fixing nip N between the fixing belt 20 and the pressure roller 10. The nip forming member 30 has a length longer than that of the pressure roller 10. The nip forming member 30 includes a guide member 31 that comes into contact with an inner surface of the fixing belt 20 to guide and press the fixing belt 20 and a support member 32 that is disposed above the guide member 31 to press and support the guide member 31.

The guide member 31 comes into contact with the inner surface of the fixing belt 20 to form the fixing nip N and guides the fixing belt 20 so that the fixing belt 20 can smoothly run around the fixing nip N. The guide member 31 has an inverted arch cross section, and thus has the support member 32 received therein. The cross section of the guide member 31 may have a U-letter shape with a substantially flat bottom. The cross section of the guide member 31 may have a structure with a large inertia moment like an I-beam, an H-beam or the like, besides the U-letter shape with the flat bottom. The support member 32 may be made of a material having excellent strength such as stainless steel or carbon steel.

The heat source 70 is disposed to directly perform radiation heating on at least a part of the inner circumferential surface of the fixing belt 20.

A lower surface of the nip forming member 30, that is, a lower surface 31*a* of the guide member 31 comes into contact with the inner surface of the fixing belt 20 and an upper part of the pressure roller 10 contacting a part of the fixing belt 20 supported by the lower surface 31*a* of the guide member 31 forms the fixing nip N. Therefore, if the pressure roller 10 rotates, the fixing belt 20 rotates by the friction with the pressure roller 10.

Both ends of the guide member 31 may each be provided with the guide bushings 100 and 100' in a longitudinal direction. A pair of guide bushings 100 and 100' are coupled to the support member 32. Further, the pair of guide bushings 100 and 100' are disposed to be pressurized in a direction of the pressure roller 10 along a rail of a frame of the image forming apparatus 1000 (not illustrated).

The pair of guide bushings 100 and 100' are disposed at both ends of the fixing belt 20 to rotatably support the fixing belt 20. In the following description, the guide bushings 100 and 100' (first and second guide bushings) may be formed in the same manner, and therefore the first and second guide bushings 100 and 100' will be collectively referred to as the guide bushings 100. Hereinafter, the guide bushing 100 included in the fixing apparatus 1 according to the exemplary embodiment of the present disclosure will be described in detail with reference to FIGS. 4 and 5.

The first guide bushing 100 and the second guide bushing 100' have the same shape and structure and the same operating state. Therefore, only the first guide bushing 100 will be described below.

Figure 4:
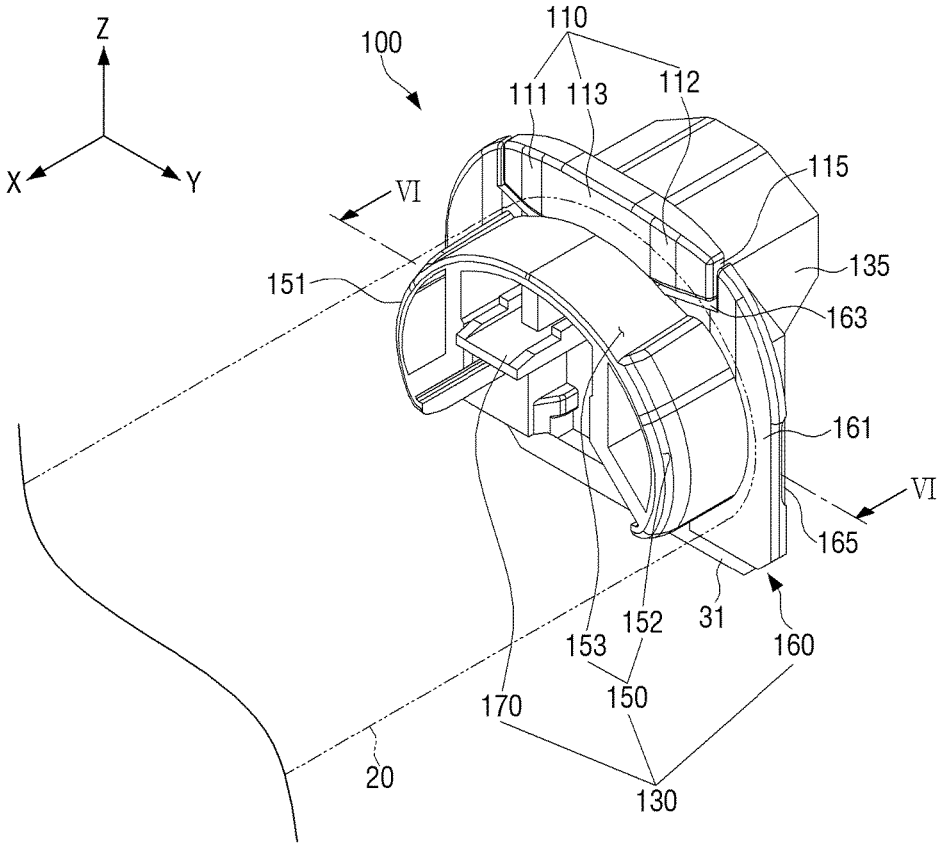
FIG. 4 is a perspective view showing an example of a guide bushing included in the fixing apparatus according to the exemplary embodiment of the present disclosure.
Figure 5:
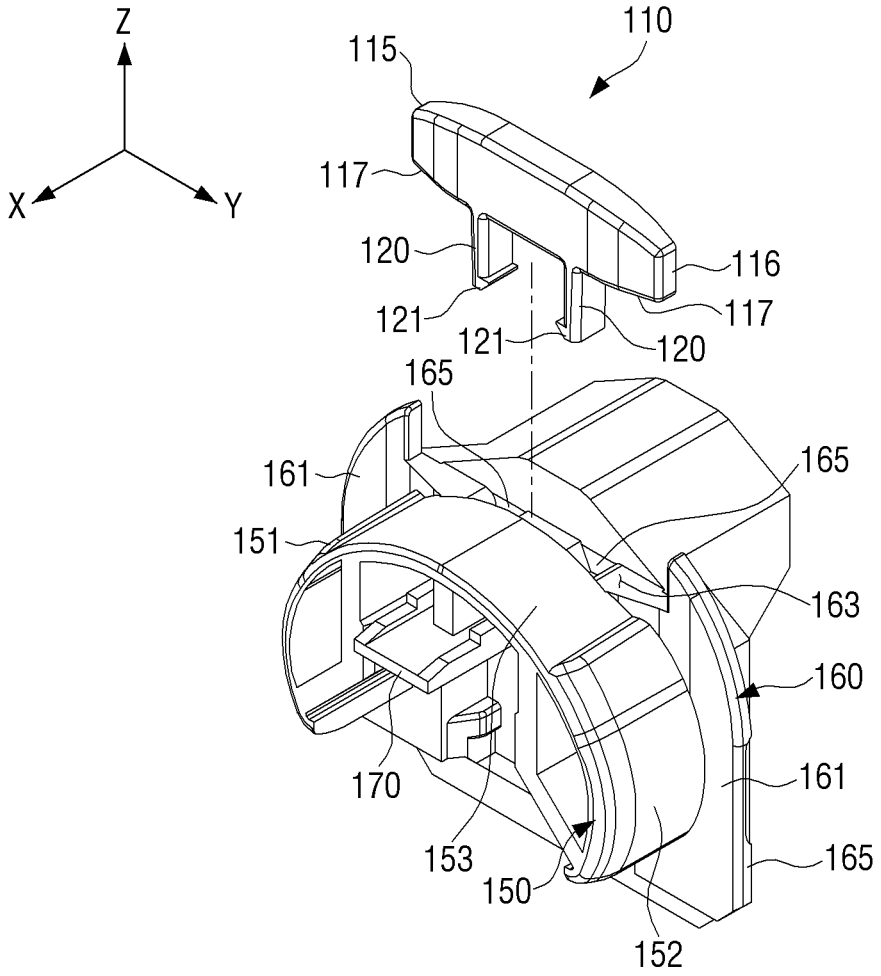
FIG. 5 is an exploded perspective view of the guide bushing of FIG. 4.

FIG. 4 is a perspective view showing an example of the guide bushing 100 included in the fixing apparatus 1 according to the exemplary embodiment of the present disclosure and FIG. 5 is an exploded perspective view of the guide bushing 100 of FIG. 4.

The fixing apparatus 1 may non-uniformly contact with the nip forming member 30 provided in the fixing belt 20 in an axial direction, besides the fixing nip N during the rotation of the fixing belt 20 or the rotating shaft of the fixing belt 20 and the rotating shaft of the pressure roller 10 are not parallel to each other, such that the distributions of the frictional forces on the inner and outer surfaces of the fixing belt 20 may be different. As a result, the phenomenon that a meandering force of the fixing belt 20 is generated in an axial direction to allow the fixing belt 20 to move in the axial direction, that is, the meandering of the fixing belt 20 occurs. One end of the fixing belt 20 comes into contact with the guide bushing 100 by the meandering of the fixing belt 20 and the guide bushing 100 may be scratched or provided with a valley-shaped groove by the friction between the fixing belt 20 and the guide bushing 100. The groove of the guide bushing 100 thus formed has the problem that the fixing belt 20 is prevented from rotating along the rotation trajectory of the fixing belt 20 or a stress is applied to both ends of the fixing belt 20.

The fixing apparatus 1 of the present disclosure includes a moving member 110 contacting one end of the fixing belt 20 by the meandering of the fixing belt 20, in which the moving member 110 moves by the friction with the fixing belt 20. The moving member 110 moves in the same direction as the rotation trajectory of the fixing belt 20 when contacting the fixing belt 20. Specifically, the moving member 110 moves so that a part of the moving member 110 contacting the fixing belt 20 moves toward a tangential direction of the rotation trajectory of the fixing belt 20. Accordingly, since the rotation of the fixing belt 20 is not disturbed by the moving member 110 moving along the trajectory of the fixing belt 20, the stress generated on both ends of the fixing belt 20 may be minimized.

Hereinafter, the structure of the guide bushing 100 supporting the fixing belt 20 in a state in which the moving member 110 of the present disclosure is movable will be described.

Referring to FIG. 4, the guide bushings 100 and 100' are to support one end or the other end of the fixing belt 20 and are configured of the moving member 110 and a fixed member 130.

The fixed member 130 includes a guide member 150 guiding the rotation of the fixing belt 20, a support portion 160 limiting a movable range of the moving member 110, and a coupling member 170 coupled to the moving member 110.

The support portion 160 is provided at both ends of the fixing belt 20. The support portion 160 is formed to have a constant width on a YZ plane perpendicular to the longitudinal direction of the fixing belt 20 to limit the axial movement of the fixing belt 20.

A receiving groove 163 into which the moving member 110 can be inserted is formed on an upper part of the support portion 160, and the guide member 150 is disposed on a front surface of the support portion 160. A fixed body 135 fixed to the frame of the image forming apparatus 1000 is disposed on a rear surface of the support portion 160.

The moving member 110 supports both ends of the fixing belt 20 in a movable state and is disposed at an upper end of the fixed member 130 in the movable state.

The receiving groove 163 into which the moving member 110 is inserted has a concave shape to correspond to a shape of the moving member 110. The receiving groove 163 is formed to be larger than the moving member 110. Specifically, the receiving groove 163 has a predetermined gap with respect to both side surfaces 115 and 116 and a lower surface 117 of the moving member 110. Accordingly, the moving member 110 is movable in a Y-axis direction by a side gap and movable in a Z-axis direction by a lower gap. That is, the moving member 110 moves on the YZ plane.

The moving member 110 is movable only within a range of a gap spaced apart from the receiving groove 163 and moves within the range of the receiving groove 163. That is, the receiving groove 163 may limit the moving range of the moving member 110.

The moving member 110 is disposed between the guide member 150 formed on the front surface of the support portion 160 and the fixed body 135 formed on the rear surface thereof. The moving member 110 can not move in the X-axis direction.

The receiving groove 163 is provided with a through hole 165 through which a hook portion 120 of the moving member 110 may pass and the coupling member 170 is disposed under the receiving groove 163. The coupling member 170 is coupled to the moving member 110 to prevent the moving member 110 from separating from the fixed member 130. The coupling member 170 may be formed under the receiving groove 163. The coupling member 170 may be coupled to the hook portion 120 of the moving member 110 that has passed through the through hole 165 of the receiving groove 163.

The hook portion 120 protrudes downward from the lower surface 117 of the moving member 110 and has hook rings 121 and 121 formed on a lower part thereof. The hook portion 120 is formed in two, in which the hook portions 120 are disposed to be spaced apart from each other by a width of the coupling member 170 so that the coupling member 170 can be disposed between the two hook portions 120. The hook rings 121 and 121 are coupled to both side surfaces of the coupling member 170. Accordingly, the moving member 110 is not separated from the receiving groove 163.

The hook rings 121 and 121 are coupled to the coupling member 170 at a predetermined gap. Specifically, a predetermined gap is formed between the lower surface and the side surface of the coupling member 170 and the hook portion 120. However, the gap between the side surface of the coupling member 170 and the hook portion 120 may be insignificant so that the moving member 110 is not separated from the fixed member 130. The moving member 110 is movable on the YZ plane by the gap formed between the hook rings 121 and 121 and the coupling member 170 and can rotate clockwise or counterclockwise on the YZ plane.

The moving member 110 may move within a range of the gap between the hook rings 121 and 121 and the coupling member 170.

The moving member 110 is coupled to the fixed member 130 in such a manner that the hook rings 121 and 121 are snap-coupled to both side surfaces of the coupling member 170, but the present disclosure is not limited thereto. The moving member 110 is coupled to the fixed member 130 so that it is movable within a range of the receiving groove 163 without being separated from the receiving groove 163.

The moving member 110 moves on the YZ plane perpendicular to the longitudinal direction of the fixing belt 20. Specifically, the moving member 110 may be movable in the Y-axis direction, which is the width direction of the fixing belt 20 and even in the Z-axis direction, which is the height direction H of the fixing belt 20. Further, the moving member 110 can rotate clockwise or counterclockwise on the YZ plane.

Specifically, the moving member 110 may move in the tangential direction with respect to the rotation trajectory of the fixing belt 20.

The moving member 110 has a shape corresponding to the receiving groove 163 so that it may be inserted into the receiving groove 163. In addition, the moving member 110 has a volume smaller than that of the receiving groove 163 so that the side surfaces 115 and 116 and the bottom surface 117 of the moving member 110 may be separated from the receiving groove 163.

The moving member 110 is formed to be convex in the axial direction of the fixing belt 20. Therefore, the meandering fixing belt 20 comes into contact with the moving member 110. Both ends of the fixing belt 20 come into contact with only the moving member 110 and the moving member 110 moves within the range of the receiving groove 163 by the friction with the fixing belt 20.

A center of the moving member 110 is provided with a central regulating surface 113 formed to be most convex toward the fixing belt 20 and both sides of the central regulating surface 113 are provided with first and second regulating surfaces 111 and 112 so that the moving member 110 has a gradually convex shape not to interfere with the rotation of the fixing belt 20. As the first regulating surface 111 approaches the central regulating surface 113, the first regulating surface 111 is closer to the fixing belt 20 and as the second regulating surface 112 also approaches the central regulating surface 113, the second regulating surface 112 is also closer to the fixing belt 20. The first and second regulating surfaces 111 and 112 of the moving member 110 adjacent to the support portion 160 are formed to be inclined up in the rotation direction of the fixing belt 20 with respect to the support portion 160. Therefore, when the fixing belt 20 rotates, one end of the fixing belt 20 may easily enter the moving member 110 of the guide bushing 100.

The support portion 160 is provided at both ends of the fixing belt 20. The support portion 160 is formed on the YZ plane perpendicular to the longitudinal direction of the fixing belt 20 to limit the axial movement of the fixing belt 20.

The width of the support portion 160 is formed to be narrower than that of the moving member 110 so that the front surface 161 of the support portion 160 does not contact one end of the fixing belt 20. Therefore, both ends of the fixing belt 20 come into contact with only the moving member 110.

The guide member 150 perpendicularly extends from the front surface 161 of the support portion 160 in the axial direction of the fixing belt 20 and supports the fixing belt 20 so that the fixing belt 20 can rotate. First and second stepped portions 151 and 152 with which the fixing belt 20 comes into contact are provided at right angles to the support portion 160. Specifically, the entire width of the first and second stepped portions 151 and 152 are formed to be right angles to the front surface 161 of the support portion 160.

The guide member 150 may be formed in various shapes as long as it can support the rotation of the fixing belt 20. The guide member 150 may have an arc shape to provide a space for the nip forming member 30 so that the fixing nip N is formed at the lower part thereof. The guide member 150 may have an arc shape that is larger or smaller than a semi circle.

The guide member 150 may include at least one of the stepped portions 151 and 152 that come into contact with the inner surface of the fixing belt 20. The first and second stepped portions 151 and 152 protrude from an outer circumferential surface of the guide protrusion 150 within a range in which one end of the fixing belt 20 does not come into contact with the moving member 110. Therefore, the stepped portions 151 and 152 of the guide member 150 may come into contact with the inner surface of the fixing belt 20.

A guide surface 153 with which the inner surface of the fixing belt 20 does not come into contact is recessed between the first and second stepped portions 151 and 152. Therefore, the stepped portions 151 and 152 of the guide member 150 and the regulating surfaces 111, 112, and 113 of the moving member 110 are staggered from each other.

The guide bushing 100 includes the fixed body 135 and the through hole 165. The fixed body 135 is formed on the rear surface of the support portion 160 and fixes the guide bushing 100 to the frame of the image forming apparatus 1000. The through hole 165 is formed on both side surfaces of the support portion 160 and inserts the guide bushing 100 into the frame of the image forming apparatus 1000. The pressure of the pressure roller 10 deforms the shape of the fixing belt 20 near the fixing nip N and a stress due to the shape deformation of the fixing belt 20 is concentrated on both ends of the fixing belt 20 outside the fixing nip N. Further, a stress is concentrated on both ends of the fixing belt 20 due to shaking or twisting of the rotating shaft of the fixing belt 20 during the rotation of the fixing belt 20.

The guide bushings 100 that support both ends of the fixing belt 20 during the rotation of the fixing belt 20 may be worn by the friction with both ends of the fixing belt 20. Specifically, the support portion 160 may be scratched by the friction with edges of both ends of the fixing belt 20 or may be provided with the valley-shaped groove.

The existing fixing belt has a problem in that both ends of the fixing belt are worn by scratches or grooves formed on the guide bushing. However, the present disclosure can solve the existing problem by allowing the moving member 110 movable to correspond to the rotational direction of the fixing belt 20 to support the fixing belt 20. Accordingly, the stress generated on the fixing belt 20 by the pair of guide bushings 100 is reduced, and the risk of damaging both ends of the fixing belt 20 due to the scratches or grooves formed on the guide bushings 100 and 100' is reduced.

Figure 6:
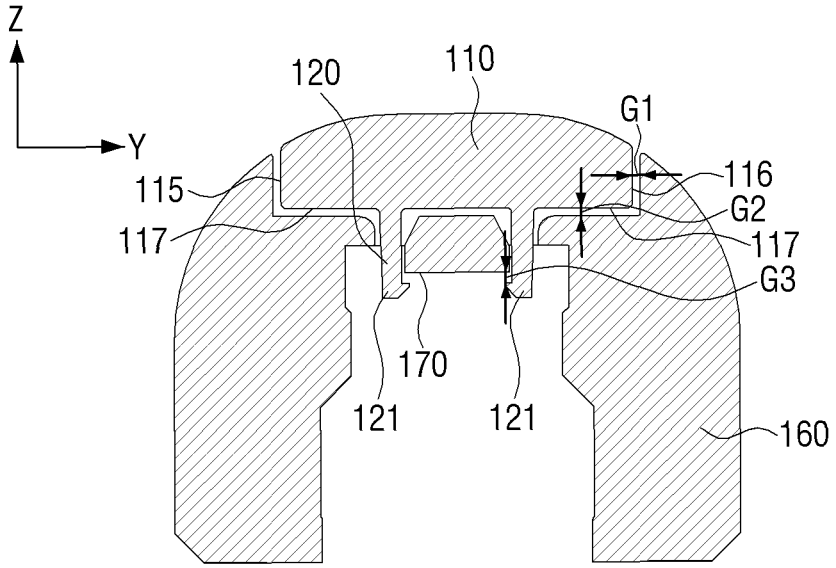
FIG. 6 is a cross-sectional view of the guide bushing of FIG. 4 taken along the line VI-VI.

FIG. 6 is a cross-sectional view of the guide bushing 100 of FIG. 4 taken along the line VI-VI.

Referring to FIG. 6, the moving member 110 is coupled to the fixed member 130 at a predetermined gap to be movable on the YZ plane perpendicular to the longitudinal direction of the fixing belt 20.

Specifically, both side surfaces 115 and 116 of the moving member 110 are spaced apart from the support portion 160 at a predetermined gap G1 in the width direction W of the fixing belt 20 so that the moving member 110 can move in the width direction of the fixing belt 20.

The lower surface 117 of the moving member 110 is spaced apart from the receiving groove 163 of the support portion 160 at a predetermined gap G2 in the height direction H of the fixing belt 20 so that the moving member 110 can move in the height direction H of the fixing belt 20. At this time, the gap G2 in the height direction H of the fixing belt 20 may preferably be 0.8 mm-1 mm.

In addition, the hook portion 120 is also coupled to the coupling member 170 at a clearance to allow the moving member 110 to be moveable with respect to the fixed member 130. The moving member 110 may not only move up and down or left and right on the YZ plane, but also rotate clockwise or counterclockwise by a gap G3 between the hook portion 120 and the coupling member 170. The hook portion 120 and the coupling member 170 are spaced apart from each other so that the moving member 110 can rotate by 3° clockwise or counterclockwise, respectively.

FIG. 6 illustrates the gap G2 between the lower surface 117 of the moving member 110 and the receiving groove 163 of the support portion 160. However, the lower surface 117 of the moving member 110 may come into contact with the receiving groove 163 by gravity.

Although not illustrated in FIG. 6, in order for the fixing apparatus 1 to form the gap G2 between the lower surface 117 of the moving member 110 and the support portion 160 from the beginning, an elastic member (not shown) for supporting the moving member 110 may be disposed within the receiving groove 163.

Figure 7A:
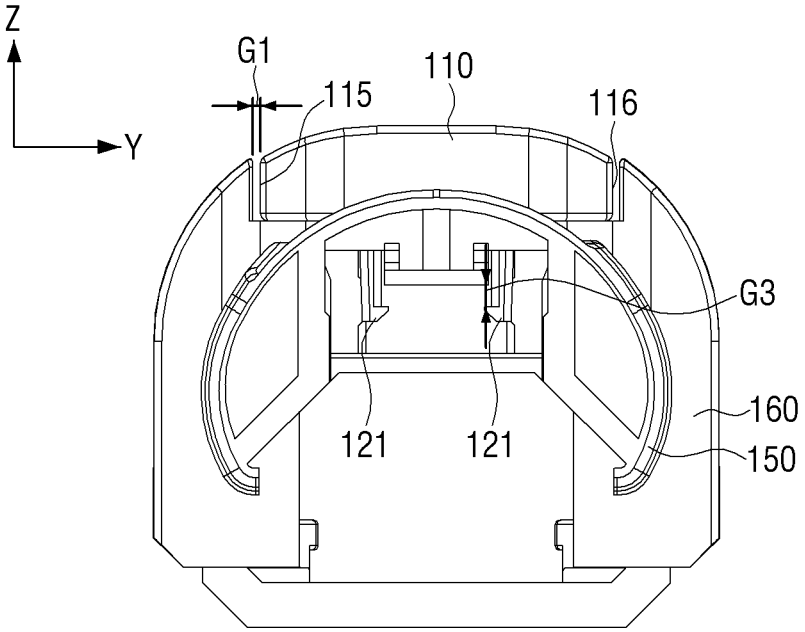
FIGS. 7A to 7C are views showing a state in which the guide bushing of FIG. 4 guides the fixing belt.
Figure 7B:
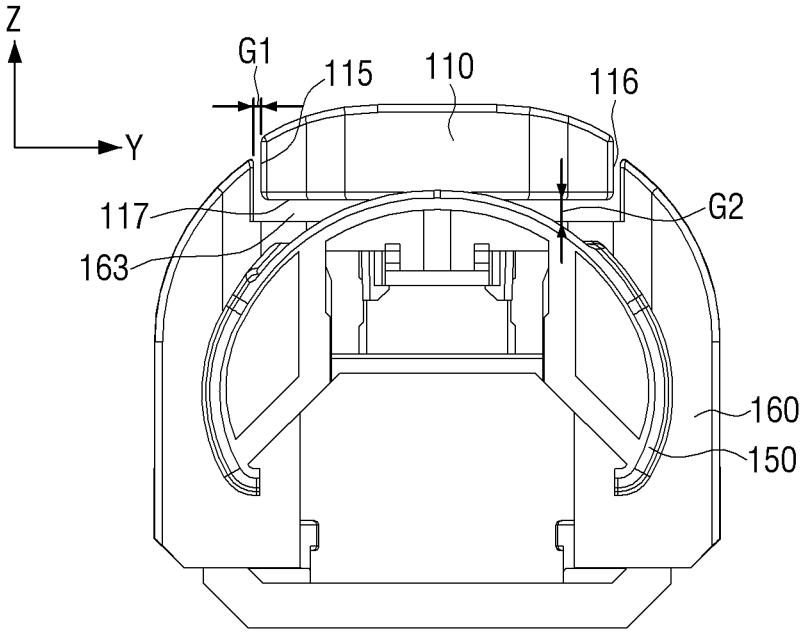
Figure 7C:
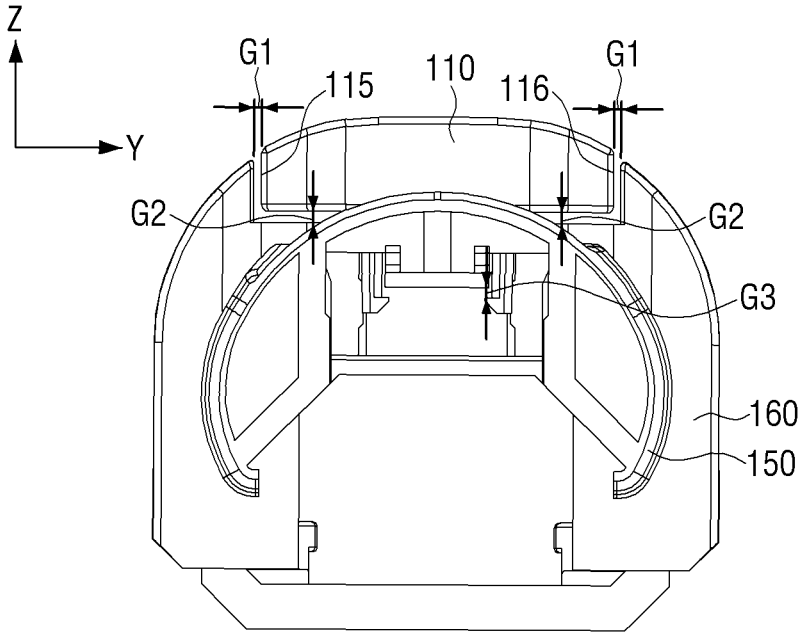

FIGS. 7A to 7C are views showing a state in which the guide bushing 100 of FIG. 4 guides the fixing belt 20.

Referring to FIGS. 7A to 7C, the operation in which the moving member 110 of the guide bushing 100 moves along the varying rotation trajectory of the fixing belt 20 will be described. As the rotation trajectory of the fixing belt 20 changes, the moving member 110 may move as shown in FIGS. 7A to 7C.

One end or the other end of the fixing belt 20 comes into contact with the moving members 110 of each guide bushing 100 by the meandering force generated when the fixing belt 20 rotates and the moving member 110 moves along the rotation trajectory of the fixing belt 20. As the moving member 110 moves, a stress generated at both ends of the fixing belt 20 is reduced by the guide bushing 100, and a stress element generated at both ends of the fixing belt 20 by the scratches or the like formed on the moving member 110 is reduced. Therefore, the lifetime of the fixing belt 20 may be increased.

FIG. 7A illustrates a state in which the gap G2 between the lower surface 117 of the moving member 110 and the support portion 160 is smallest, with the moving member 110 being close to the rotation center of the fixing belt 20.

There is almost no gap G2 between the lower surface 117 of the moving member 110 and the support portion 160. Specifically, the lower surface 117 of the moving member 110 comes into contact with the receiving groove 163 of the support portion 160. At this time, the gap G3 between the coupling member 170 and the hook portion 120 becomes maximum.

FIG. 7A illustrates an initial state of the fixing apparatus 1 or a state of regulating a minimum rotating radius of the fixing belt 20.

In the initial state of the fixing apparatus 1, the moving member 110 comes into contact with the support portion 160 by gravity.

If the fixing belt 20 rotates at the minimum rotating radius when the moving member 110 is in the state of FIG. 7B or 7C to be described later, as illustrated in FIG. 7A, the moving member 110 moves toward the rotation center of the fixing belt 20 along the rotation trajectory having the minimum rotating radius of the fixing belt 20.

At this time, the moving member 110 may not only move to reduce the gap G2, but also move so that the gap G1 of one side surface 115 of the moving member 110 is reduced and the gap G1 of the other side surface 116 thereof is increased, depending on the rotation direction of the fixing belt 20 and the moving member 110 may rotate on the YZ plane clockwise or counterclockwise.

FIG. 7B illustrates a state in which the gap G2 between the lower surface 117 of the moving member 110 and the support portion 160 is largest, with the moving member 110 being far away from the rotation center of the fixing belt 20.

The gap G2 between the lower surface 117 of the moving member 110 and the support portion 160 becomes maximum and the gap G3 between the coupling member 170 and the hook portion 120 becomes minimum, such that the hook portion 120 comes into contact with the lower end of the coupling member 170.

FIG. 7B illustrates the state of regulating the maximum rotating radius of the fixing belt 20 in the fixing apparatus 1.

If the fixing belt 20 rotates at the maximum rotating radius when the moving member 110 is in the state of FIG. 7A or a state of FIG. 7C to be described later, as illustrated in FIG. 7B, the moving member 110 moves in an opposite direction to the rotation center of the fixing belt 20 along the rotation trajectory having the maximum rotating radius of the fixing belt 20.

At this time, the moving member 110 may not only move to increase the gap G2, but also move so that the gap G1 of one side surface 115 of the moving member 110 is reduced and the gap G1 of the other side surface 116 thereof is increased, depending on the rotation direction of the fixing belt 20 and the moving member 110 may rotate on the YZ plane clockwise or counterclockwise.

FIG. 7C illustrates a state in which the moving member 110 is located between a maximum range and a minimum range in which the moving member 110 can move. FIG. 7C illustrates a state in which the gap G2 is present between the lower surface 117 of the moving member 110 and the support portion 160 and the gap G3 is present even between the coupling member 170 and the hook portion 120.

FIG. 7C illustrates the state in which the guide bushing 100 regulates when the fixing belt 20 has a rotating radius between the maximum rotating radius and the minimum rotating radius.

When the moving member 110 is changed to the state shown in FIG. 7A or 7B or moves from the state of FIG. 7B to the state of FIG. 7A, the moving member 110 is subjected to the state shown in FIG. 7C.

Hereinafter, other exemplary embodiments of a guide bushing will be described. The same components as the fixing apparatus 1 and the guide bushing 100 according to the exemplary embodiment of the present disclosure described above are denoted by the same reference numbers.

Figure 8:
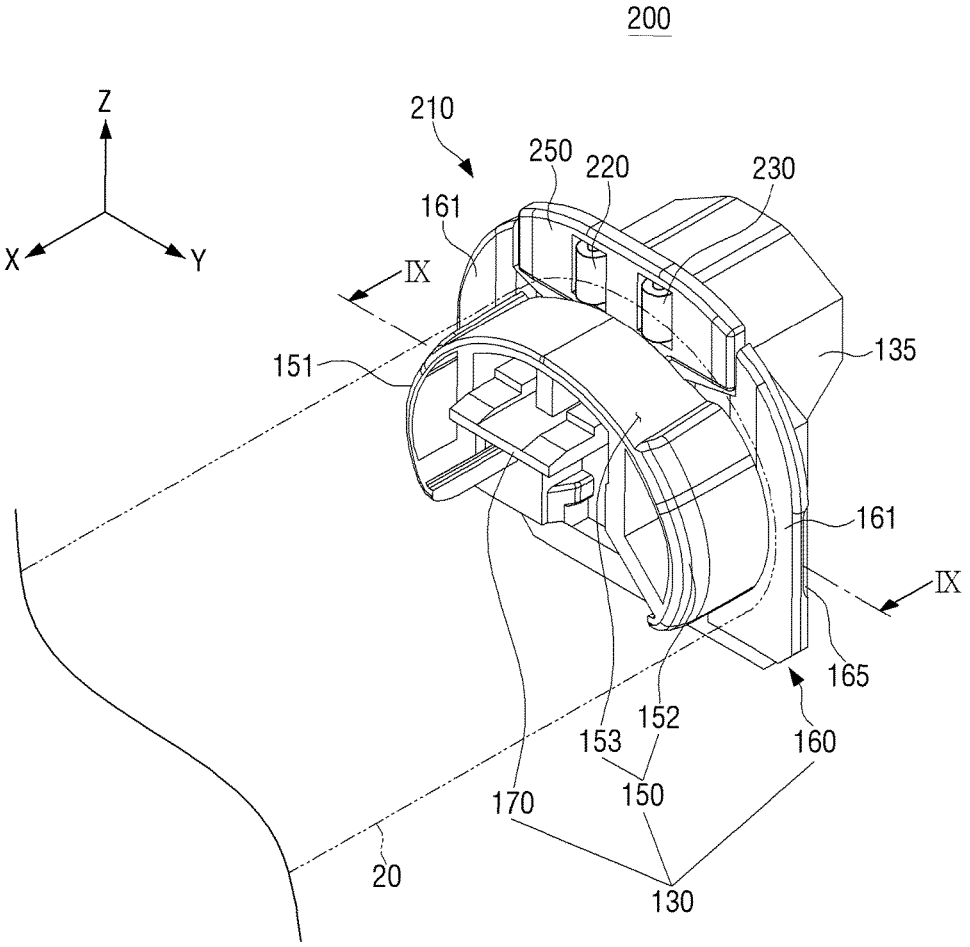
FIG. 8 is a perspective view showing another example of the guide bushing included in the fixing apparatus according to the exemplary embodiment of the present disclosure.
Figure 9:
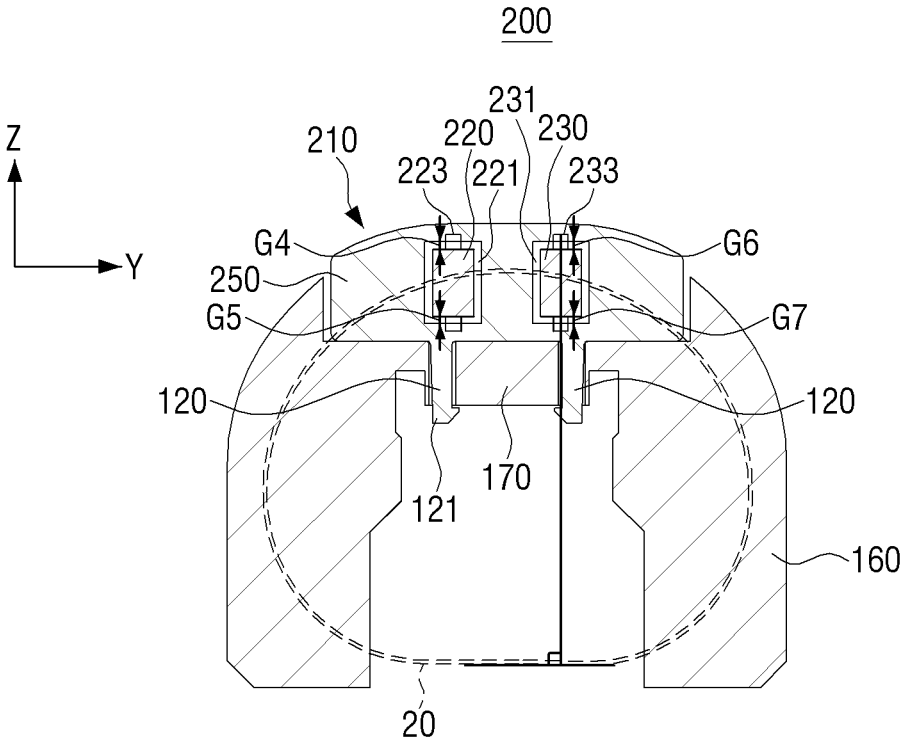
FIG. 9 is a cross-sectional view of the guide bushing of FIG. 8 taken along the line IX-IX.

FIG. 8 is a perspective view showing another example of a guide bushing 200 included in the fixing apparatus 1 according to the exemplary embodiment of the present disclosure and FIG. 9 is a cross-sectional view of the guide bushing 200 of FIG. 8 taken along the line IX-IX.

As illustrated in FIG. 8, a moving member 210 includes first and second rollers 220 and 230 and a roller support portion 250 for supporting the first and second rollers 220 and 230.

The roller support portion 250 is disposed on the YZ plane perpendicular to the longitudinal direction of the fixing belt 20 to support both ends of the fixing belt 20 like the moving member 110 of FIG. 4 and has a shape corresponding to the receiving groove 163 to be coupled with the fixed member 130. At this time, the roller support portion 250 may be fixedly coupled to the fixed member 130.

The roller support portion 250 may have the same width as the support portion 160 of the fixed member 130 not to contact both ends of the fixing belt 20. Both ends of the fixing belt 20 contact only the first and second rollers 220 and 230 and do not contact the roller support portion 250. The roller support portion 250 is provided with first and second roller grooves 221 and 231 so that the first and second rollers 220 and 230 may be rotatably disposed. The roller grooves 221 and 231 are formed so that the first and second rollers 220 and 230 can move up and down. The up and down movement ranges of the first and second rollers 220 and 230 can be regulated by the roller grooves 221 and 231. The first and second rollers 220 and 230 are formed so that rotating shafts 223 and 233 are perpendicular to the longitudinal direction of the fixing belt 20 (see FIG. 9). That is, the rotating shafts 223 and 233 are formed to coincide with the Z-axis perpendicular to the fixing nip N.

The first and second rollers 220 and 230 protrude from the roller support portion 250 to come into contact with one end or the other end of the fixing belt 20. At this time, the roller support portion 250 has a smaller width than the first and second rollers 220 and 230 not to contact both ends of the fixing belt 20. That is, the width of the roller support portion 250 is formed to be equal to or smaller than that of the support portion 160 of the fixed member 130. The first roller 220 not only rotates within the roller groove 221 but also is movable up and down along the rotating shaft 223. That is, the first roller 220 is movable in the Z-axis direction which is the height direction H of the fixing belt 20.

Referring to FIG. 9, if the roller grooves 221 and 231 are formed to have gaps G4 and G6 between the upper surfaces of the first and second rollers 220 and 230 and upper surfaces 221*b* and 231*b* of the roller grooves 221 and 231 or gaps G5 and G7 between the lower surfaces of the first and second rollers 220 and 230 and lower surfaces 221*a* and 231*a* of the roller grooves 221 and 231, as the fixing belt 20 moves, the first and second rollers 220 and 230 may be disposed so that the predetermined gaps G4, G5, G6, and G7 are formed at the upper and lower parts of the first and second rollers 220 and 230 as illustrated in FIG. 9.

One end of the fixing belt 20 comes into contact with at least any one of the first and second rollers 220 and 230 of the moving member 210 by the meandering of the fixing belt 20.

If the fixing belt 20 and the first roller 220 come into contact with each other, the first roller 220 moves along the rotation trajectory of the fixing belt 20. The first roller 220 rotates in the direction corresponding to the rotation direction of the fixing belt 20 and moves up and down.

As the first roller 220 moves by the rotation of the fixing belt 20 during the rotation of the fixing belt 20, the friction between both ends of the fixing belt 20 and the guide bushing 200 may be reduced, and the stress applied to both ends of the fixing belt 20 may be dispersed through the first roller 220.

The first roller 220 can move on the YZ plane perpendicular to the longitudinal direction of the fixing belt 20. Specifically, the first roller 220 of the moving member 210 can rotate with respect to the rotating shaft 223 coinciding with the Z-axis, and is movable even in the Z-axis direction that is the height direction H of the fixing belt 20.

Since the second roller 230 has the same configuration and operation as the first roller 220, the detailed description thereof will be omitted.

Figure 10A:
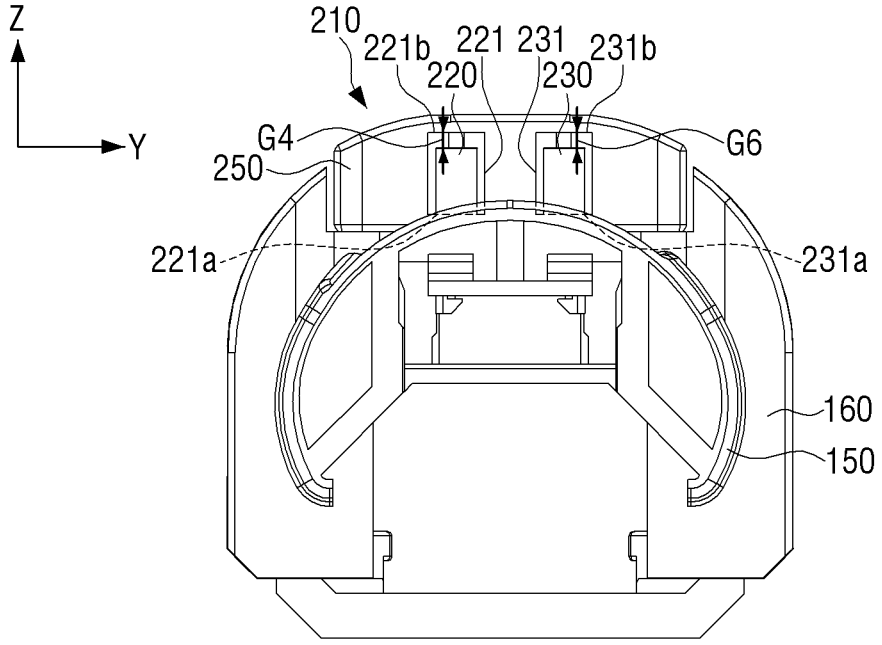
FIGS. 10A to 10C are views showing a state in which the guide bushing of FIG. 8 guides the fixing belt.
Figure 10B:
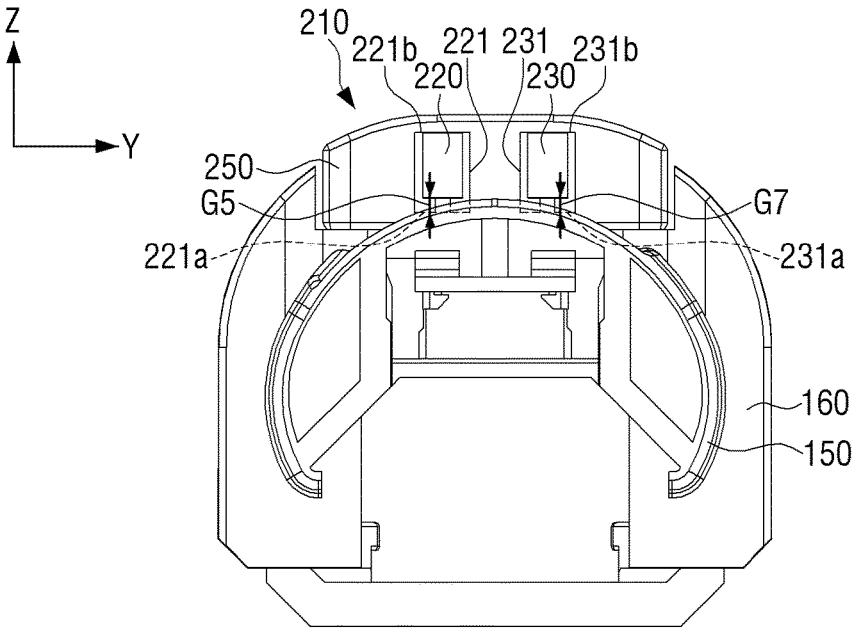
Figure 10C:
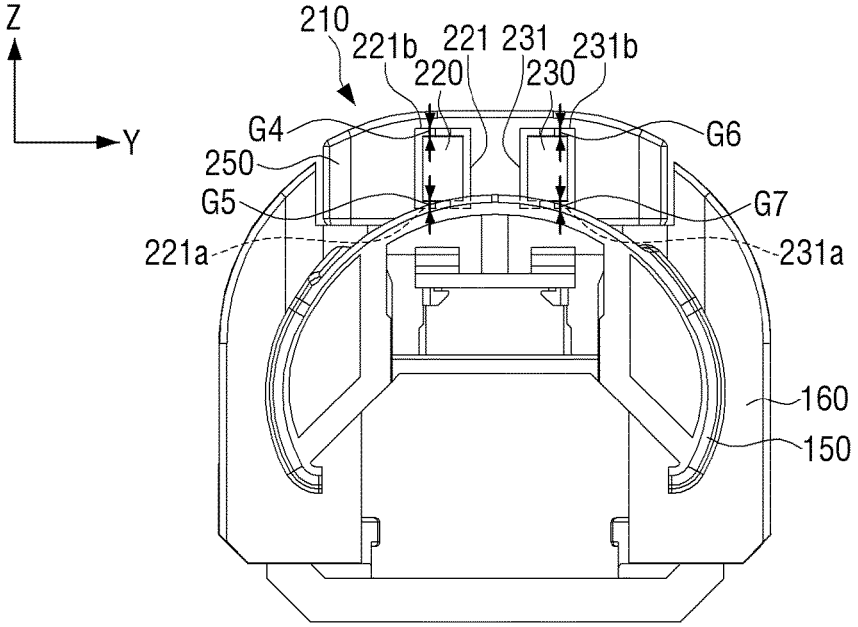

FIGS. 10A to 10C are views showing the state in which the guide bushing 200 of FIG. 8 guides the fixing belt 20.

The operation in which the first and second rollers 220 and 230 of the moving member 210 which regulates both ends of the fixing belt 20 moves along the rotation trajectory of the fixing belt 20 will be described with reference to FIGS. 10A to 10C.

One end or the other end of the fixing belt 20 comes into contact with the first roller 220 or the second roller 230 of each of the moving members 210 by the meandering occurring when the fixing belt 20 rotates.

The first or second roller 220 or 230 of the moving member 210 which is part of the guide bushing 200 of the present disclosure moves along the rotation trajectory of the fixing belt 20. As the first or second roller 220 or 230 moves, the friction due to the contact of both ends of the fixing belt 20 with the moving member 210 of the guide bushing 200 is reduced, and the stress elements applied to the both ends of the fixing belt 20 by the scratches or the like formed on the moving member 210 is reduced. Therefore, the lifetime of the fixing belt 20 may be increased.

The first and second rollers 220 and 230 move along the rotation trajectory of the fixing belt 20.

FIG. 10A illustrates a state in which the first and second rollers 220 and 230 come into contact with the lower surfaces 221*a* and 231*a* of the roller grooves 221 and 231. FIG. 10A illustrates that all of the first and second rollers 220 and 230 come into contact with the lower surfaces 221*a* and 231*a* of the roller grooves 221 and 231, but the present disclosure is not limited thereto. Accordingly, the first or second roller 220 or 230 may come into contact with the lower surfaces 221*a* and 231*a* of the roller grooves.

The gaps G5 and G7 between the first and second rollers 220 and 230 and the lower surfaces 221*a* and 231*a* of the roller grooves 221 and 231 are smallest. At this time, the gaps G4 and G6 between the first and second rollers 220 and 230 and the upper surfaces 221*b* and 231*b* of the roller grooves become maximum.

FIG. 10A illustrates an initial state of the fixing apparatus 1 or a state of regulating a minimum rotating radius of the fixing belt 20. In the initial state of the fixing apparatus 1, the first and second rollers 220 and 230 contact the lower surfaces 221*a* and 221*b* of the roller grooves 221 and 231 by gravity. If the fixing belt 20 rotates in the minimum rotating radius when the first and second rollers 220 and 230 are in the state of FIG. 10B or 10C to be described later, as illustrated in FIG. 10A, the first and second rollers 220 and 230 rotate along the rotation trajectory having the minimum rotating radius of the fixing belt 20 and move down.

FIG. 10B illustrates a state in which the first and second rollers 220 and 230 are far away from the lower surfaces 221*a* and 231*a* of the roller grooves 221 and 231. At this time, the gaps G5 and G7 between the first and second rollers 220 and 230 and the lower surfaces 221*a* and 231*a* of the roller grooves 221 and 231 become maximum and the gap between the first and second rollers 220 and 230 and the upper surfaces 221*b* and 231*b* of the roller grooves 221 and 231 becomes minimum. That is, the first and second rollers 220 and 230 come into contact with the upper surfaces 221*b* and 231*b* of the roller grooves 221 and 231.

FIG. 10B illustrates the state of regulating the maximum rotating radius of the fixing belt 20 in the fixing apparatus 1. If the fixing belt 20 rotates in the maximum rotating radius when the first and second rollers 220 and 230 are in the state of FIG. 10A or a state of 10C to be described later, as illustrated in FIG. 10B, the first and second rollers 220 and 230 rotate along the rotation trajectory having the maximum rotating radius of the fixing belt 20 and move up.

FIG. 10C illustrates a state in which the first and second rollers 220 and 230 are located between the maximum range and the minimum range in which they can move. FIG. 10C illustrates a state in which gaps G4, G5, G6, and G7 are present between the first and second rollers 220 and 230 and the upper and lower parts of the roller grooves 221 and 231. FIG. 10C illustrates the state in which the first and second rollers 220 and 230 regulate when the fixing belt 20 has a rotating radius between the maximum rotating radius and the minimum rotating radius. When the first and second rollers 220 and 230 are changed to the state shown in FIG. 10A or 10B or move from the state of FIG. 10B to the state of FIG. 10A, the first and second rollers 220 and 230 are subjected to the state shown in FIG. 10C.

Figure 11:
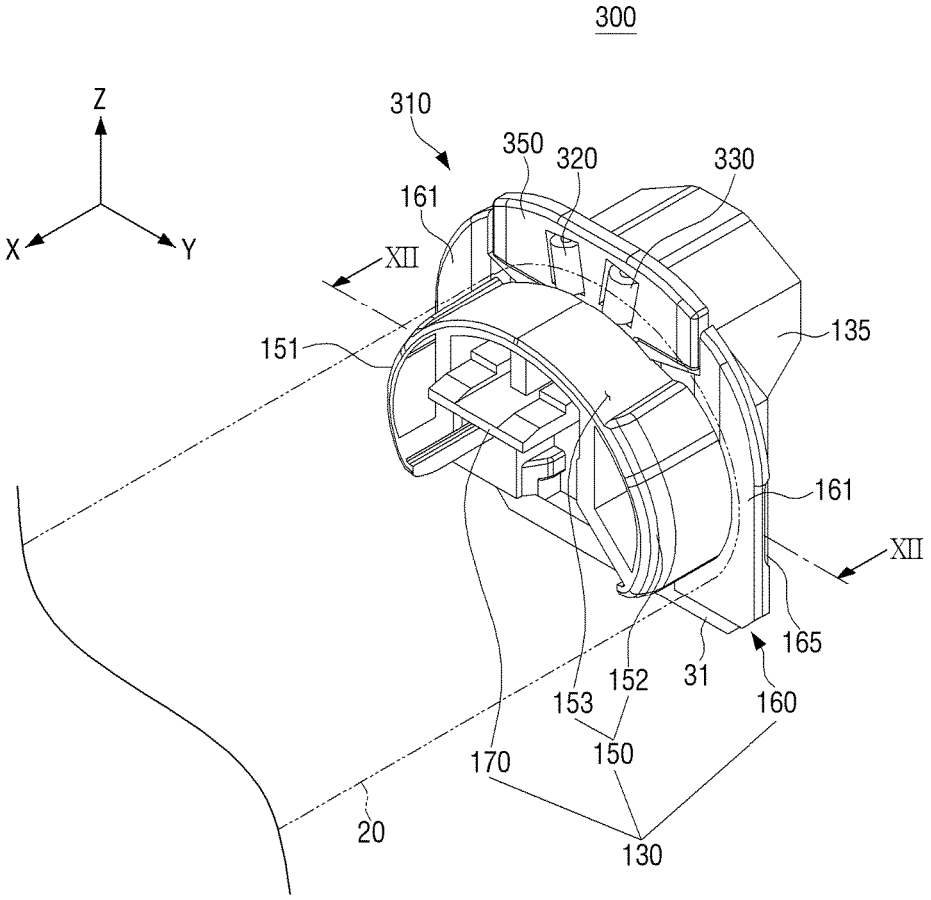
FIG. 11 is a perspective view showing another example of the guide bushing included in the fixing apparatus according to the exemplary embodiment of the present disclosure.
Figure 12:
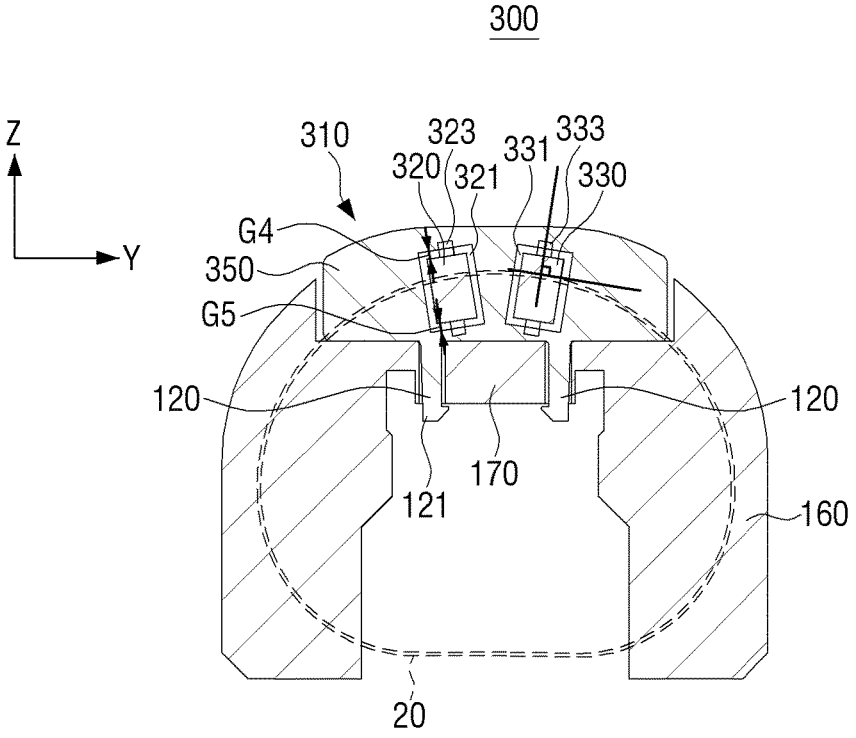
FIG. 12 is a cross-sectional view of the guide bushing of FIG. 11 taken along the line XI-XI.

FIG. 11 is a perspective view showing another example of a guide bushing 300 included in the fixing apparatus 1 according to the exemplary embodiment of the present disclosure and FIG. 12 is a cross-sectional view of the guide bushing 300 of FIG. 11 taken along the line XI-XI.

Referring to FIG. 11, a moving member 310 includes a plurality of rollers 320 and 330 and a roller support portion 350 for supporting the rollers 320 and 330. Unlike the moving member 210 of FIG. 8 including the first and second rollers 220 and 230 rotatably disposed with respect to a straight line perpendicular to the longitudinal direction of the fixing belt 20 as a rotating shaft, the moving member 310 of FIG. 11 includes the pair of rollers 320 and 330 disposed to rotate with respect to a line perpendicular to the tangential line of the fixing belt 20 as the rotating shaft.

In order for the moving member 310 to move in the tangential direction with respect to the rotation trajectory of the fixing belt 20 at the point meeting the fixing belt 20, the rotating shafts 323 and 333 of the rollers 320 and 330 are disposed to coincide with a normal line with respect to the rotation trajectory of the fixing belt 20. Accordingly, the rollers 320 and 330 can rotate in the tangential direction with respect to the rotation trajectory of the fixing belt 20.

The rollers 320 and 330 can move up and down along and rotate with respect to the rotating shafts 323 and 333 in roller grooves 321 and 331, and therefore the rollers 320 and 330 can move in the tangential direction with respect to the rotation trajectory of the fixing belt 20 at the point meeting the fixing belt 20.

Figure 13A:
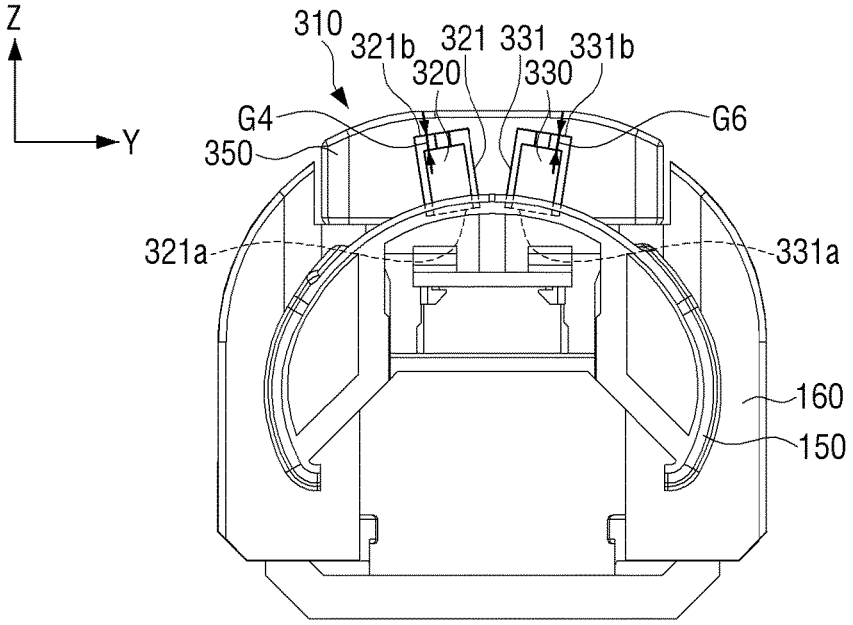
FIGS. 13A to 13C are views showing a state in which the guide bushing of FIG. 11 guides the fixing belt.
Figure 13B:
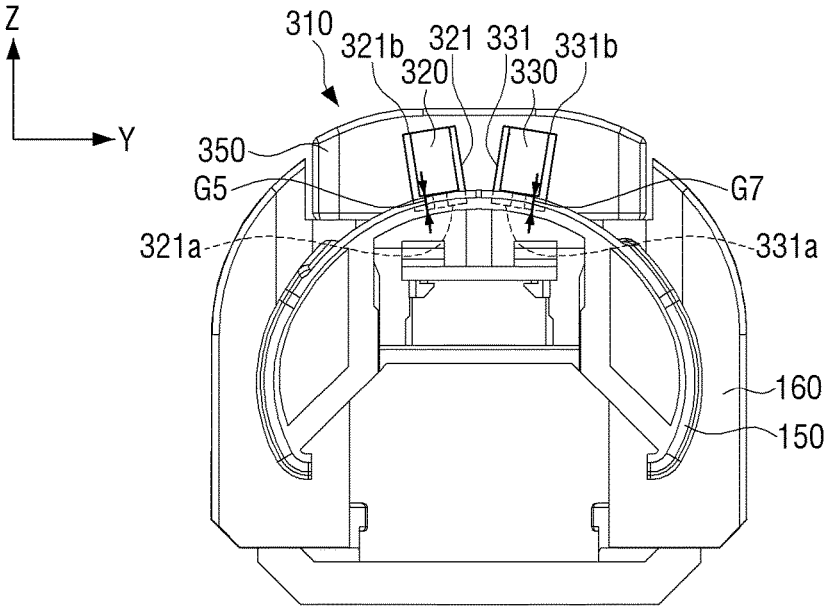
Figure 13C:
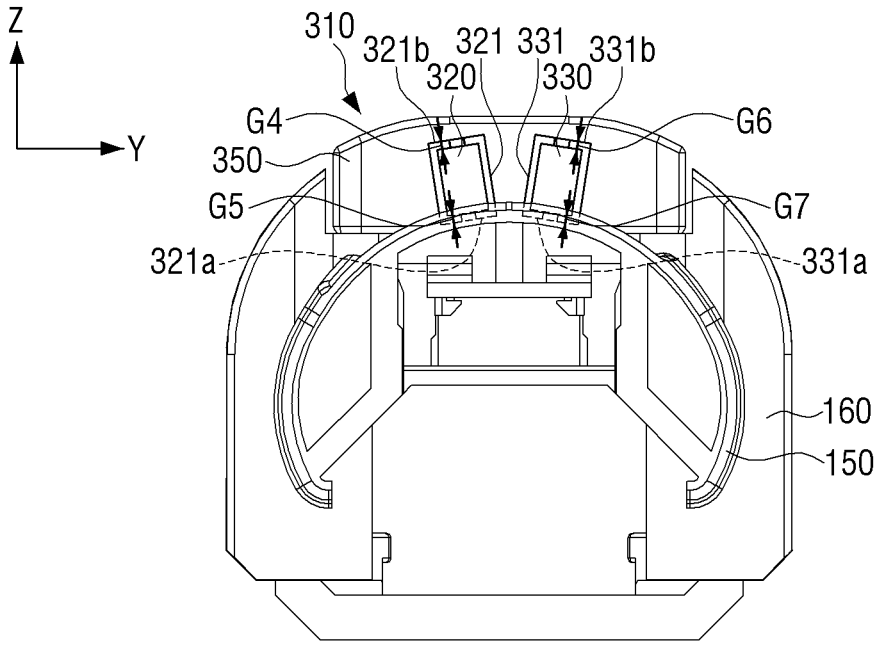

FIGS. 13A to 13C are views showing the state in which the guide bushing 300 of FIG. 11 guides the fixing belt 20.

The operation in which the pair of rollers 320 and 330 of the moving member 310 which regulates both ends of the fixing belt 20 along the rotation trajectory of the fixing belt 20 moves will be described with reference to FIGS. 13A to 13C. One end or the other end of the fixing belt 20 comes into contact with the rollers 320 and 330 of each of the guide bushings 300 by the meandering force occurring when the fixing belt 20 rotates. The rollers 320 and 330 of the moving member 310 which are part of the guide bushing 300 of the present disclosure move along the rotation trajectory of the fixing belt 20.

FIG. 13A illustrates the initial state of the fixing apparatus 1 or the state in which the minimum rotating radius of the fixing belt 20 is regulated, with the rollers 320 and 330 coming into contact with the lower surfaces 321*a* and 331*a* of the roller grooves 321 and 331. In the initial state of the fixing apparatus 1, if the rollers 320 and 330 come into contact with the lower surfaces 321*a* and 331*a* of the roller grooves 321 and 331 by gravity and the fixing belt 20 is rotated in the minimum rotating radius, as illustrated in FIG. 13A, the rollers 320 and 330 rotate along the rotation trajectory having the minimum rotating radius of the fixing belt 20 and move down.

FIG. 13B illustrates a state in which the rollers 320 and 330 come into contact with the upper surfaces 321*b* and 331*b* of the roller grooves 321 and 331, with the rollers 320 and 330 being far away from the lower surfaces 321*a* and 331*a* of the roller grooves 321 and 331. FIG. 13B illustrates the state of regulating the maximum rotating radius of the fixing belt 20 in the fixing apparatus 1. If the fixing belt 20 rotates in the maximum rotating radius, as illustrated in FIG. 13B, the rollers 320 and 330 rotate along the rotation trajectory having the maximum rotating radius of the fixing belt 20 and move up.

FIG. 13C illustrates a state in which the rollers 320 and 330 are located between the maximum range and the minimum range in which they can move. FIG. 13C illustrates a state in which gaps G4, G5, G6, and G7 are present between the rollers 320 and 330 and the upper and lower parts of the roller grooves 321 and 331. FIG. 13C illustrates the state in which the rollers 320 and 330 regulate when the fixing belt 20 has a rotating radius between the maximum rotating radius and the minimum rotating radius.

In the fixing apparatus according to the exemplary embodiment of the present disclosure, the guide bushing for supporting both ends of the fixing belt includes the moving member capable of moving depending on the rotation of the fixing belt, such that the stress applied to both ends of the fixing belt generated by the contact of the fixing belt with the moving member may be minimized.

Hereinabove, the present disclosure is described based on an exemplary method. Terms used herein are for description and are not to be understood as the limited meaning. The present disclosure may be variously modified and changed according to the above contents. Therefore, unless additionally mentioned, the present disclosure may be freely practiced within a scope of claims.

What is claimed is:

1. A fixing apparatus, comprising:

a fixing belt including a first end and a second end;

a pressure roller to contact the fixing belt;

a nip forming member to press the fixing belt to the pressure roller to form a nip, the nip forming member including a first end and a second end; and first and second guide bushings to be respectively disposed at the first and second ends of the nip forming member to respectively support the first and second ends of the fixing belt, each of the first and second guide bushings including a moving member which is movable.

2. The fixing apparatus as claimed in claim 1, wherein each of the first and second guide bushings includes a fixed member fixable to the nip forming member; and the moving member is coupleable to the fixed member in a state.

3. The fixing apparatus as claimed in claim 2, wherein the moving member is coupled to the fixed member with a gap between a side surface of the moving member and the fixed member.

4. The fixing apparatus as claimed in claim 2, wherein the fixed member includes:

a support portion including a receiving groove into which the moving member is insertable; and a coupling member coupleable to the moving member so that the moving member remains in the receiving groove.

5. The fixing apparatus as claimed in claim 4, wherein the coupling member is disposed under the receiving groove.

6. The fixing apparatus as claimed in claim 4, wherein the receiving groove is spaced apart from both side surfaces of the moving member.

7. The fixing apparatus as claimed in claim 4, wherein the moving member includes a hook portion protruding downward, and a lower end of the hook portion is provided with a hook ring coupled to a side surface of the coupling member.

8. The fixing apparatus as claimed in claim 7, wherein the hook ring and the coupling member are coupled to each other and form a gap.

9. The fixing apparatus as claimed in claim 4, wherein the moving member is spaced apart from the fixed member in a height direction of the fixing belt.

10. The fixing apparatus as claimed in claim 9, wherein the support portion is provided with an elastic member to elastically support the moving member to support the moving member to the support portion at a gap.

11. The fixing apparatus as claimed in claim 2, wherein the moving member is spaced apart from the fixed member in a width direction of the fixing belt.

12. The fixing apparatus as claimed in claim 2, wherein the moving member is formed to be convex in a central direction of the fixing belt.

13. The fixing apparatus as claimed in claim 2, wherein the moving member includes a plurality of rollers rotatably coupleable to the fixed member.

14. The fixing apparatus as claimed in claim 13, wherein the plurality of rollers are disposed to have a rotating shaft perpendicular to a longitudinal direction of the fixing belt.

15. The fixing apparatus as claimed in claim 14, wherein the plurality of rollers are disposed in parallel with each other.

16. The fixing apparatus as claimed in claim 13, wherein the plurality of rollers are disposed to have a rotating shaft coinciding with a normal line with respect to a rotation trajectory of the fixing belt.

17. The fixing apparatus as claimed in claim 13, wherein the moving member further includes a roller support portion to support the plurality of rollers, and the roller support portion is provided with a plurality of roller grooves in which the plurality of rollers are correspondingly disposed.

18. The fixing apparatus as claimed in claim 17, wherein the roller is disposed at an upper part or a lower part of the roller groove at a gap.

19. The fixing apparatus as claimed in claim 18, wherein the roller support portion is formed so that the plurality of rollers protrude in a central direction of the fixing belt from the roller support portion.

20. An image forming apparatus, comprising:

a photoreceptor to form an electrostatic latent image;

a developing unit to supply a toner to the electrostatic latent image to form a toner image on a recording medium; and a fixing apparatus to apply heat and pressure to the toner image formed on the recording medium to fix the toner image to the recording medium, the fixing apparatus including:

a fixing belt including a first end and a second end, a pressure roller to contact the fixing belt, a nip forming member to be disposed inside the fixing belt and press the fixing belt to the pressure roller to form a nip, the nip forming member including a first end and a second end, and first and second guide bushings to be respectively disposed at the first and second ends of the nip forming member, each of the first and second guide bushings including a moving member to move in a plane substantially perpendicular to an axis of rotation of the fixing belt.

* * * * *